US005938388A

United States Patent [19]

Bloser et al.

[11] Patent Number: 5,938,388

[45] Date of Patent: Aug. 17, 1999

[54] METHOD AND DEVICE FOR PREPARING, MANIPULATING, AND PROCESSING A STAPLE WIRE FOR STAPLING SHEETS IN A STAPLING APPARATUS

[75] Inventors: Helmut Bloser, Lonsee; Heinz-Guenter Bethmann, Fellbach; Joachim Buck, Laichingen; Helmut Funk, Remshalden; Rolf Hascher, Geislingen; Juergen Ries, Ostfildern; Gert Scheufler, Winnenden, all of Germany

[73] Assignee: Eastman Kodak Company, Rochester, N.Y.

[21] Appl. No.: 09/044,354

[22] Filed: Mar. 19, 1998

[30] Foreign Application Priority Data

Mar. 27, 1997 [DE] Germany ..... 197 12 863

[51] Int. Cl.[6] ..... B21D 53/46

[52] U.S. Cl. ..... 412/1; 412/28; 412/33; 29/13; 59/71; 59/75

[58] Field of Search ..... 29/13; 59/71, 75; 412/28, 31, 1

[56] References Cited

U.S. PATENT DOCUMENTS

| | | | |
|---|---|---|---|
| 2,910,697 | 11/1959 | Mott | 59/75 |
| 4,318,555 | 3/1982 | Adamski et al. . | |
| 4,722,467 | 2/1988 | Kunka et al. . | |
| 4,898,314 | 2/1990 | Stroh . | |

FOREIGN PATENT DOCUMENTS

| | | |
|---|---|---|
| 0 013 164 | 9/1984 | European Pat. Off. . |
| 0 250 141 | 12/1987 | European Pat. Off. . |
| 0 365 457 | 9/1989 | European Pat. Off. . |

OTHER PUBLICATIONS

Research Disclosure No. 29834, May 1988; Wire Feed Spool Access.

*Primary Examiner*—Willmon Fridie, Jr.
*Assistant Examiner*—Mark T. Henderson
*Attorney, Agent, or Firm*—Lawrence P. Kessler

[57] ABSTRACT

A staple wire supply roll is positioned on a threading-in device that can be moved out of a stapling apparatus, and the leading end of the wire is transported by means of a thread-in transport device, through a flexible guide tube, to a stapling device. A sensor positioned on the stapling device signals the end of the threading-in operation when the leading end of the staple wire passes by. By pushing the threading-in device into the apparatus, the staple wire transport device of the stapling device is set in motion, as a result of which the leading end of the staple wire is transported to a location which positions the leading end of the wire in device. The staple wire is transported, in accordance with the thickness of the sheet stack measured by a sensor, by a stepping motor, which at the same time drives a radial cam unit. The radial cam unit moves a cutting device into a position in which the transported staple wire segment is positioned symmetrically with respect to a shaper and driver of the stapling device and cut, and then shaped into a staple and driven into the sheet stack.

26 Claims, 5 Drawing Sheets

METHOD AND DEVICE FOR PREPARING, MANIPULATING, AND PROCESSING A STAPLE WIRE FOR STAPLING SHEETS IN A STAPLING APPARATUS

BACKGROUND OF THE INVENTION

The invention relates to a method and a device for preparing, manipulating, and processing a staple wire in an apparatus for stapling sheets, in which the staple wire is fed from a supply roll to a stapling device, a wire length dependent on the sheet stack thickness is cut off and shaped into a staple, and the staple is driven into the sheet stack.

In the case of a device of the type disclosed by U.S. Pat. No. 4,898,314, the staple wire is arranged in a cassette, and a flexible guide tube, which is joined to the cassette and whose outlet is configured as a coupling to which the wire end is attached, is provided. The staple wire is joined by means of said coupling to a wire transport device, arranged in the region of the stapling device, which transports the staple wire into the stapling device. With this known device, a complete unit consisting of cassette, guide tube, and coupling must be replaced each time the supply of staple wire is to be replenished. When a new supply of staple wire is inserted, the coupling joined to it must be delivered manually to the immediate vicinity of the stapling device.

In another device for delivering the leading end of the wire to a stapling device (U.S. Pat. No. 4,722,467), a threading-in device which has a funnel-shaped inlet opening for the wire end is provided directly upstream from the stapling device. The wire end is introduced manually into said inlet opening, and pushed forward until the leading end arrives at visible marks, from which point wire transport on the part of the stapling unit becomes effective. At the beginning of the threading-in process, a clamping device for the wire must be moved manually into an ineffective position, and, once the threaded-in position is reached, must be moved into a clamping position which prevents the staple wire from slipping back.

In the case of a loading device for a staple wire roll disclosed in Research Disclosure No. 29834, May 1988, a displaceable holder is provided on which the staple wire roll is mounted. The holder is movable from a location arranged inside an apparatus into a pulled-out location in which the staple wire roll is positioned to be accessible for replacement. With this device, the leading end of the staple wire must be pushed manually into a flexible tube leading to a transport device of a stapling head until the wire end has arrived at the transport device.

EP-B-0 013 164 has disclosed a stapling device in which the staple wire coming from a supply roll is transported, as a function of the sheet stack thickness to be stapled, by means of a transport device having clamping elements, and positioned centeredly on the stapling head. The operation of the clamping elements of this known device can be impaired, by soiling and/or by wear of the staple wire, in such a way that reliable transport of the staple wire can no longer be ensured.

Also known is a stapling device (U.S. Pat. No. 4,318,555) in which transport of the staple wire is accomplished by motor drive in such a way that a sensor detects the number of sheets to be stapled, and then sets in motion a first transport device for a shorter wire segment or a second transport device for a longer wire segment. This device does not, however, allow any intermediate sizes of wire segment for a staple size matched precisely to the particular sheet stack thickness.

With some of these known and in some cases relatively complex devices, it is necessary to deliver the wire end by hand to the immediate vicinity of the stapling device. Since the stapling device of a stapling apparatus, which can for example be arranged in a finishing device for folding, collating, stapling, and depositing sheet stacks, is as a rule arranged at a poorly accessible point in the apparatus, replenishing the staple wire supply is, with the known devices, so complex and laborious that it can be performed only by trained personnel.

SUMMARY OF THE INVENTION

It is the object of the invention to configure both delivery of staple wire to a stapling device and further transport of the staple wire in the stapling device, as well as operationally correct preparation of a staple wire segment for making a staple, in such a way that the threading-in operation can be handled easily and conveniently, and so that a simplification of the stapling device is attained.

According to the invention, this object is attained by a method including the following steps:

- the staple wire supply roll is positioned, on a support that can be moved out of the apparatus, in the moved-out position thereof, and the leading end of the wire is delivered manually to a thread-in transport device arranged on the support;
- the leading end of the staple wire is transported by the thread-in transport device, through a flexible guide tube joined to the stapling device inside the apparatus, to a standby position, signaled by a sensor, at the staple wire transport device of the stapling device;
- the support is moved into the apparatus, thereby automatically setting in motion the staple wire transport device, on the stapling device, which transports the leading end of the staple wire to a ready position which positions the leading end of the wire in the cutting position at the staple wire cutting device;
- the staple wire is transported a suitable length by a stepping motor, in accordance with the thickness, as measured by a sensor, of the particular sheet stack being stapled;
- as a function of the requisite length of the staple wire segment to be cut off, the staple wire cutting device is automatically moved by the stepping motor, by means of a radial cam driven by the latter, into a location on the stapling head of the stapling device which positions the staple wire segment symmetrically with respect to a staple shaper and driver on the stapling device, and the wire segment is cut off;
- the wire segment is automatically shaped into a staple by the shaper and driver, and the completed staple is driven into the sheet stack being stapled.

The advantageous result of the method according to the invention is that the staple wire supply roll can be placed, in easily visible fashion, on the pulled-out support configured as a threading-in device, and the staple wire can be transported from there to the stapling device of the apparatus; the stapling device can be arranged at an otherwise inaccessible point in the stapling apparatus, since the staple wire is transported to the stapling device via a flexible guide tube arranged inside the stapling apparatus. The threading-in device and the stapling device are advantageously coupled to one another in such a way that the staple wire transport device of the stapling apparatus is not applied to the staple wire and set in motion until after the staple wire stands ready in operationally correct fashion upon insertion of the threading-in device. The staple wire transport device of the stapling apparatus is advantageously driven by a stepping motor which at the same time, by means of a radial cam unit, controls a staple wire cutting device in such a way that the requisite staple wire segment is both cut off as a function of the sheet stack thickness and positioned in operationally correct fashion.

Further features and advantages are evident from an embodiment of the invention depicted in the drawings, and from the subclaims.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

The device for carrying out the method according to the invention consists of a threading-in device 2 for staple wire and a stapling device 22, 28 for shaping a staple from a wire segment cut off from a supply of staple wire and for driving the completed staple into a sheet stack, threading-in device 2 and the staple wire transport device of stapling device 22, 28 being coupled to one another in a manner yet to be described.

The device described below is part of a stapling apparatus for stacked collection and stapling of sheets and for depositing the stapled sheet products; only those components necessary for an understanding of the device according to the invention are depicted. A stapling apparatus of this kind is known, for example, from DE 38 39 297 A.

Figure 1:
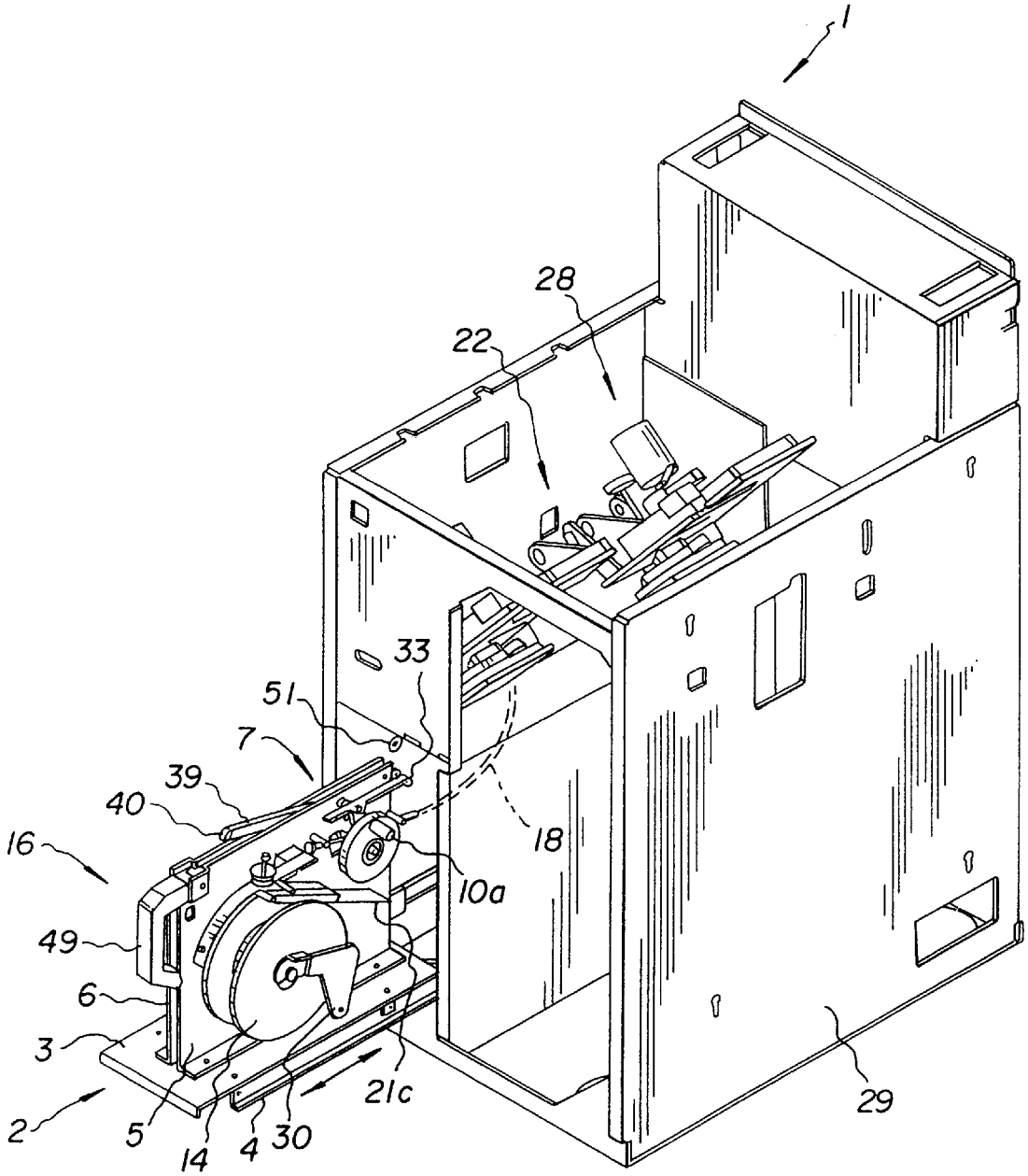
FIG. 1 is an oblique view, of the staple wire device, in a position moved out from the apparatus.

Arranged on housing 29 of stapling apparatus 1, depicted in FIG. 1, are two stapling devices 22 and 28 of known type, with which, in known fashion, a wire furnished from supply roll 14 or 16 is automatically shaped into staples as a function of the stack thickness being stapled, and driven into the respective sheet stack. Stapling devices 22 and 28 can be adjusted by displacement, in a known manner that is not depicted, to different staple spacings.

Arranged below stapling devices 22 and 28 on housing 29 is a threading-in device 2 which has a support 3, guided displaceably in known fashion on pull-out rails 4, which can be pulled out from a position, according to FIG. 2, completely pushed into housing 29 and flush with the outside of the apparatus, into a loading position depicted in FIG. 1. Two vertical walls 5 and 6 running parallel to one another, on each of which a supply roll 14 and 16, respectively, is rotatably mounted, are attached on support 3. Associated with these two supply rolls 14 and 16 are identical guide and transport devices 7, 17, of which only one is visible in FIGS. 1 and 2, so that the following description applies identically to both supply rolls 14 and 16.

Supply rolls 14 and 16 are rotatably mounted on stationary spindles 15, and have spool flanges of known type between which a commercially available coiled roll of staple wire is arranged. Pivotably mounted securing levers 30, which immobilize supply rolls 14 and 16 on spindles 15 in their axial position, are arranged on support 3. Arranged above supply rolls 14 and 16 are elastic guide elements 17 which are attached at one end 17*a* to wall 5 and 6, respectively. Attached on their top side and at the other end of guide elements 17, which are shaped approximately as circular arcs and are arranged coaxially with supply rolls 14 and 16, is a guide 17*b* which has a hole or a notch (not depicted) for guiding staple wire 50. Elastic guide elements 17 serve, in a manner yet to be described, as strain reliefs and to assist transport of the staple wire. Associated with guide elements 17 are lubricant carriers 31 which are equipped with oil-impregnated felt pieces of known type, between which staple wire 50 is guided.

A transport device 7 is attached on walls 5 and 6 as an extension of each of guide elements 17. Transport device 7, visible in particular in FIGS. 2 and 3, has a feed-in tube 13 whose one end has a funnel-shaped opening 13*a* facing guide element 17, and whose other end is directed toward the inlet roller gap of a transport roller pair 8 and 9. The one transport roller 9 is mounted in stationary fashion, and is driven via a handwheel 10, joined to transport roller 9, by means of a handle 10*a* attached thereon. The other transport roller 8, which serves as the pressure roller, is mounted pivotably about a bearing 12 on a lever 11. Transport rollers 8 and 9 are equipped with guide grooves (not depicted) of known type for staple wire 50.

Arranged between walls 5 and 6 is a two-armed control arm 39 which is also mounted pivotably about bearing 12. Levers 11 mounted on either side of walls 5 and 6, and control arm 39, are joined to one another at their one end by means of a pin 33. Engaging on said pin 33 is a tension spring 35 which acts on levers 11 and control arm 39 so as to rotate them clockwise, so that pivotable transport roller 8 can be laid against stationary transport roller 9.

Attached at the other end of levers 11 is one end of a wire 37 of respectively associated sheathed cables (Bowden cables) 36, the sheath of which is attached in known fashion to stationary mounts 38. The other end of sheathed cable wire 37 is attached to an actuator (yet to be described), which is associated respectively with one of stapling devices 22 or 28. A rotatable slide roller 40, which comes into engagement with housing 29 in a manner yet to be described, is mounted at the other end of control arm 39. Associated with the outlet roller gap of transport roller pair 8 and 9 is a feed-in tube 19 which has a coupling element 20 to which a flexible guide tube 18 of known type can be connected.

Resting under its own weight against the outside diameter of each of the staple wire rolls located on supply rolls 14 and 16 is a braking and indicating arm 21, which at one end is pivotably articulated about a stationary bearing 32, and whose other end projects beyond the spool flange of supply rolls 14 and 16. Sensors (not depicted) are arranged in the movement path of the end of braking and indicating arm 21 which projects beyond the spool flange. The sensors, configured as photoelectric barriers of known type, are arranged so that they can indicate two staple wire supply levels depending on the position of braking and indicating arm 21, namely "almost empty" in position 21*a*, and "empty" in position 21*b* (see FIGS. 2 and 3). The photoelectric barriers control corresponding indicating means of known type (not depicted) on the outside of stapling apparatus 1.

Figure 2:
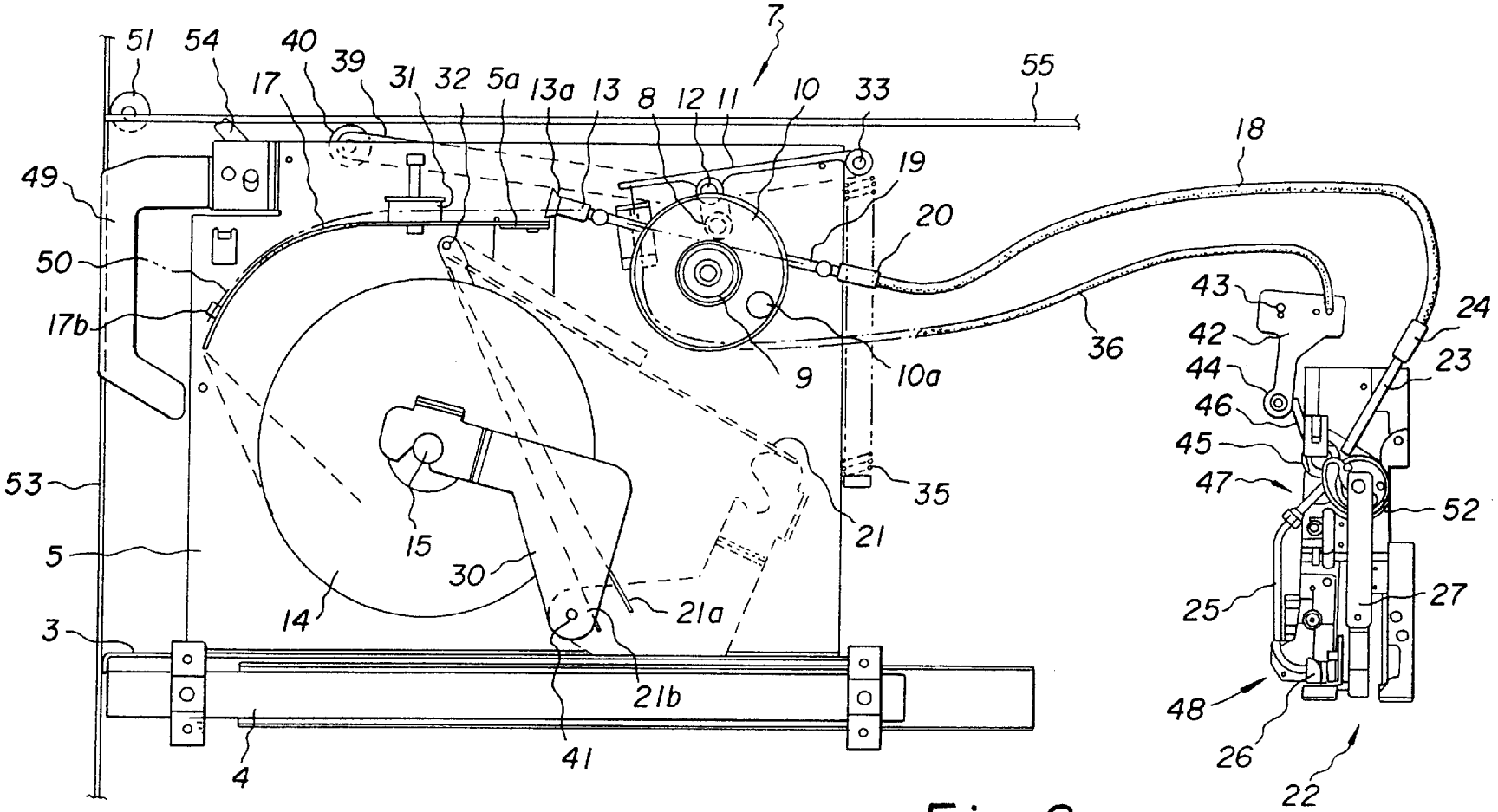
FIG. 2 is a partial view of the staple wire device according to FIG. 1 in a side view, in a position moved into the apparatus.
Figure 3:
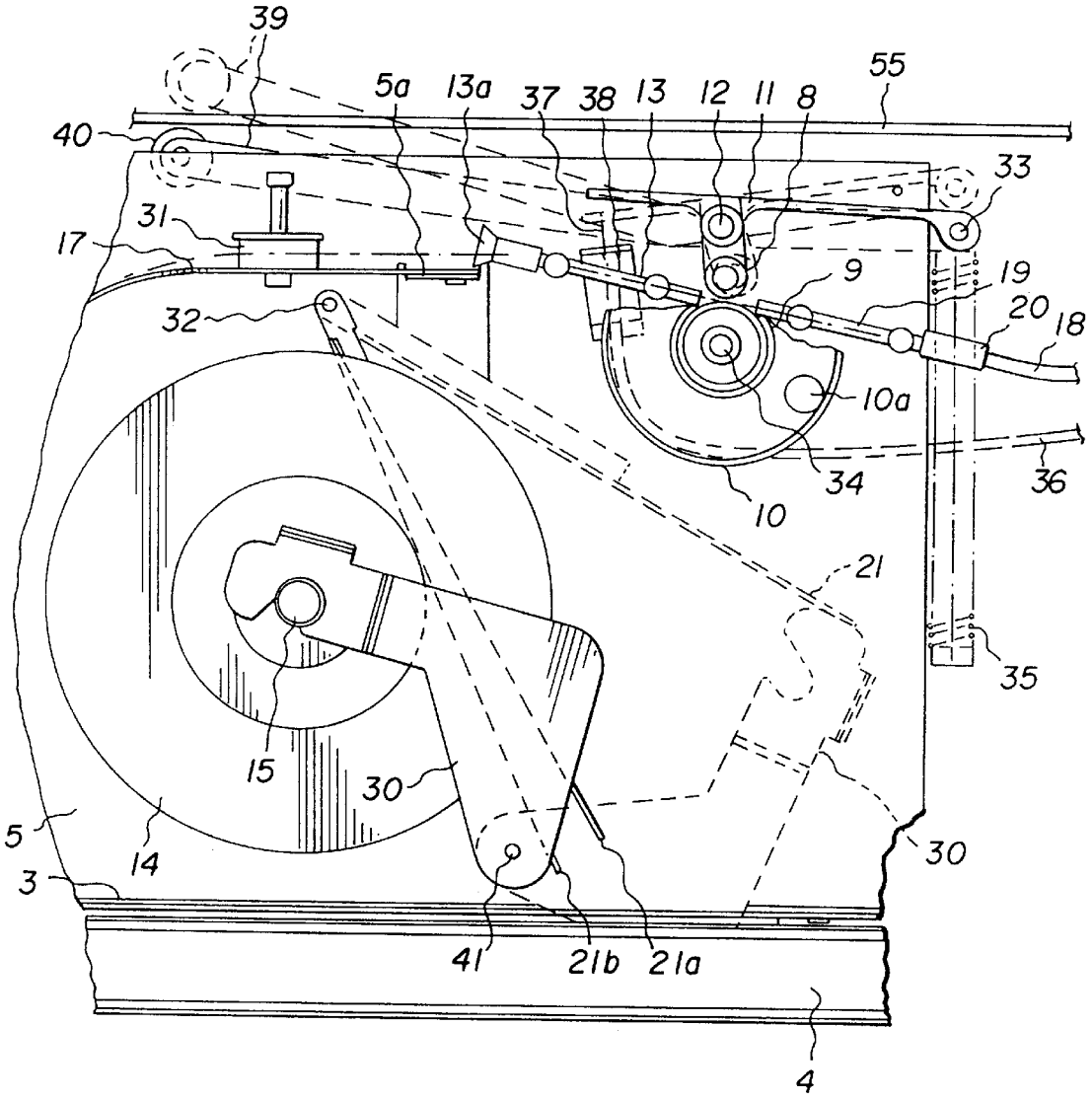
FIG. 3 is a partial view of the staple wire device according to FIG. 2.

As shown in FIG. 1, braking and indicating arms 21 have projections 21*c* which project into the pivot path of securing levers 30 in such a way that when the respective securing lever 30 pivots into the release position, the respective associated braking and indicating arm 21 is lifted away from supply roll 14 or 16 (indicated with dot-dash lines in FIGS. 2 and 3).

Transport devices 7 are joined to stapling devices 22 and 28 by the aforementioned flexible guide tube 18, which can be respectively connected, by means of a coupling element 24 of known type (not depicted), to an inlet tube 23 of stapling devices 22 and 28. From inlet tube 23 of stapling device 22 or 28, the staple wire is transported, by means of a driven transport wheel 52 mounted on the stapling device and a pressure roller 45 associated therewith, through a feed-in tube 25 to a staple wire cutting device 26 and to a staple forming and staple driving device 27 of known type. The same applies to the second stapling device 28. Pressure roller 45 is mounted on the respective stapling device 22 or 28 pivotably on an arm 46. End 44 of an actuator 42, which is mounted pivotably about a stationary bearing 43 and can be actuated by sheathed cable 36, 37 attached thereon, engages on arm 46.

Arranged in the region of the transport device of the stapling device is a first switch 47 of known type (not depicted), which projects into the transport path of the staple wire and which, when the leading end of the wire passes by pressure roller 45, activates an indicator lamp (not depicted) of known type on the outside of apparatus 1 and thus signals to the user the end of the manually driven threading-in operation, and the fact that the staple wire is ready for further motorized transport.

Stapling apparatus 1 is loaded with staple wire supply rolls 14 and 16 as follows:

First, a door 53 (indicated in FIG. 2) of known type (not depicted in further detail) on the front of the device is opened. Threading-in device 2, which is now accessible, is unlocked by turning handle 49, so that a bolt 54 of a locking device of known type (not depicted) disengages from housing 29. Threading-in device 2 is then pulled out of apparatus 1, using handle 4, to the end position shown in FIG. 1; the connection to stapling devices 22 and 28 is maintained by means of the flexibly configured guide tubes 18. In the pulled-out position, securing levers 30 are pivoted clockwise so that supply spools 14 and 16 are released, and braking and indicating arms 21 are pivoted out of the removal path of supply spools 14 and 16. An empty supply spool 14 or 16 can now be removed unimpeded, and a full supply spool can be placed onto the respective spindle 15.

After the new supply spools 14 and 16 have been put in place, securing levers 30 are pivoted counterclockwise onto spindles 15, thereby pivoting braking and indicating arms 21, which are in contact therewith, against the outside diameter of the coiled staple wire. The respective leading end of the wire is then grasped manually and guided via guide 17*a* and guide element 17 between lubricant carriers 31, inserted into the funnel-shaped opening 13*a* of feed-in tube 13, and pushed into the roller gap of transport rollers 8, 9 of transport device 7.

By rotating handwheel 10 clockwise using handle 10*a*, the leading end of the wire is then transported through feed-in tube 19 into the flexible guide tube 18, and through the latter to stapling device 22 or 28. Once the leading end has passed by the open roller gap between transport wheel 52 and pressure roller 45 on the stapling device, it actuates the first switch 47 arranged in its movement path. This activates the aforementioned indicator lamp, which signals to the user the end of the manual threading-in operation and the fact that the staple wire is ready to be automatically transported further by the transport device on the stapling device.

Both during the manually actuated staple wire threading-in operation, and during motorized transport of the staple wire at the stapling device, elastic guide element 17 acts as a strain relief for the unwinding of the staple wire from supply rolls 14 and 16, thus preventing any jerky tensile stress on staple wire 50. Elastic guide element 17 also serves as a transport means for rotation of the heavy supply spools 14 and 16, by the fact that guide element 17 is first preloaded by elastic deflection by means of the staple wire as it is being transported, until sufficient energy has been stored to overcome the inertia of supply spools 14 and 16 and rotate them.

Once the manually driven threading-in operation for both staple wire supply rolls 14 and 16 is complete, threading-in device 2 is pushed into stapling apparatus 1. As it is pushed in, control arm 39 strikes with its roller 40 against a housing-mounted roller 51, and is thereby pivoted counterclockwise. This pivoting movement is also transferred by pin 33 to levers 11, which also pivot counterclockwise so that transport roller 8, which serves as pressure roller, is pivoted away to the side and is thus lightly distanced or lifted away from stationary transport roller 9. Upon further insertion of threading-in device 2, roller 40 of control arm 39 moves along a wall 55 of housing 29.

The pivoting movement of levers 11 also causes wire 37 of sheathed cable 36 to be pushed into its stationary sheath, which causes actuator 42 to pivot clockwise. The pivoting movement of actuator 42 in turn results in a counterclockwise rotation of spring-loaded tracking arm 46, so that pressure roller 45 rests in spring-loaded fashion against transport wheel 52 of stapling device 22 or 28. The connection by way of sheathed cable 36 thus ensures that pressure roller 45 of stapling device 22 or 28 is effective in functionally correct fashion when the manually actuated threading-in operation is complete.

When threading-in device 2 reaches its pushed-in end position, a switch (not depicted) is actuated and sets the transport device of the stapling device in motion. The staple wire is then transported by transport wheel 52, in a manner yet to be described, until the beginning of the staple wire actuates a second switch 48 (not depicted), projecting into the transport path of the staple wire in the region of cutting device 26, after which wire transport is halted, after a defined number of transport steps, when the leading end of the wire has reached its starting position in the cutting position of cutting device 26 of stapling device 22 or 28. The staple wire transport device of stapling device 22 or 28 is now in a starting position from which staple shaping, controlled on the basis of stack thickness in a manner yet to be described, can be accomplished automatically.

In the pushed-in end position of threading-in device 2, its bolt 54 automatically snaps into place. Door 49 is then closed.

During the operation of stapling device 22 or 28, an indication of the staple wire supply is provided by braking and indicating arm 21 which, as already mentioned, activates a corresponding indication on the outside of the device. When the staple wire supply is running out, the "almost empty" indication is provided in position 21*a*, and when the staple wire is exhausted, the "empty" indication is given in position 21*b*.

When threading-in device 2 is pulled out into its threading-in position, as already described, to be loaded with new supply rolls 14 and 16, roller 40 of control arm 39 is no longer in contact with wall 55 of housing 29. Control arm 39 is thus released, and pivots clockwise together with levers 11 in response to tension spring 35. During the pivoting movement of lever 11, wire 37, attached thereto, of sheathed cable 36 is pulled, causing its other end to move actuator 42 so as to rotate counterclockwise. As a result, arm 46 on the stapling device pivots pressure roller 45 into a position lifted away from transport wheel 52, so that the manually driven threading-in operation can proceed, unimpeded, through the now-open roller gap between pressure roller 45 and transport wheel 52.

Because of the control operation described above, however, transport roller 8 of threading-in device 2 serving as the pressure roller rests, under the action of tension spring 35, in functionally correct fashion against the stationary transport roller 9 of transport device 7 of threading-in device 2. The position of pressure rollers 8 and 45 is thus automatically controlled by sheathed cable 36, as a function of the respective end position of threading-in device 2, in such a way that in both end positions, functionally correct wire transport can occur without interference and without additional actions by the user, thus considerably simplifying the threading-in operation.

The configuration and control system of the staple wire transport device on the stapling device, to which the aforementioned transport wheel 52 and its pressure roller 45 belong, will be described below. This device serves to transport and position a staple wire segment and is part of a commercially available stapling device 22 or 28 (not described in further detail) for shaping and driving staples into a sheet stack 57. Stapling device 22 or 28 has, in the usual manner, a stapling head 56 on which a staple shaper and driver 27, the construction and operation of which are not subjects of the invention and therefore will not be described in more detail, is movably arranged.

Arranged in the region of stapling head 56 is a staple wire cutting device 26 which is guided displaceably in arrow direction "B" perpendicular to driving-in direction "A". For this purpose, stapling device 22 or 28 and cutting device 26 are equipped with a V-guide 22*a* and 26*a,* visible in FIG. 4, for positive guidance of cutting device 26. Arranged on cutting device 26 is a cutting knife 67, 68 having wedge-shaped edges, depicted schematically in FIG. 5, the movably guided blade 67 of which can be moved perpendicular to staple wire 50 by a drive device (not depicted) of stapling device 22 or 28. The wedge-shaped edges of cutting knife 67 and 68 cut off staple wire 50 in such a way that the wire ends have wedge-shaped points so that they can penetrate more easily into sheet stack 57.

A fork-shaped end 66*a* of a first arm of a control lever 66, which is mounted pivotably about a stationary bearing 69, engages positively on a projection 26*b* of cutting device 26. A projection arranged at end 66*b* of a second arm of control lever 66 engages positively into a radial cam 59*a* or 59*b* of a radial cam unit 59. Radial cam unit 59 is mounted rotatably about a stationary shaft 65. An overrunning clutch 62, one end of which is configured as a gear 63 that is immovably joined to radial cam unit 59, is rotatably mounted on shaft 65. A gear 58*b,* which is attached on the motor shaft 58*a* of a stepping motor 58 mounted on stapling device 22 or 28, engages into gear 63 of overrunning clutch 62. The other end 64 of overrunning clutch 62 is immovably joined to a transport wheel 52 mounted rotatably on shaft 65. Gear 63 and the other end 64 of overrunning clutch 62 are coupled to one another via a catch (not depicted) of known type, the effect of which is that transport wheel 52 can be driven by stepping motor 58 only in rotation direction "D".

Radial cam unit 59 has a first cam segment 59*a,* arranged concentrically with the rotation axis of shaft 65, that is associated with a constant minimum wire segment length that is provided for a sheet stack thickness of, for example, two sheets. Adjoining first cam segment 59*a* is a second cam segment 59*b* with a rising cam profile, which is associated with greater wire segment lengths that are provided for a sheet stack thickness of, for example, three sheets up to 10 mm. The position of cam segment 59*a* or of the respective region of cam segment 59*b* with respect to end 66*b* of control lever 66 which engages against the latter is determined in accordance with a measurement device (not depicted). The measurement device controls stepping motor 58, which rotates radial cam unit 59 and transport wheel 52 in arrow direction "D" by an amount corresponding to the requisite length of the wire segment.

The measurement device (not depicted) can be a sensor which scans the stack thickness, or can be constituted by a sheet counting device, optionally in conjunction with a prior input of the paper weight.

Rotation of radial cam unit 59 in arrow direction "D" causes, in the rising portion of cam segment 59*b,* a displacement of cutting device 26 in arrow direction "B", specifically in accordance with the determined thickness of sheet stack 57 being stapled.

As already described, pressure roller 45 rests in spring-loaded fashion against transport wheel 52.

Figure 4:
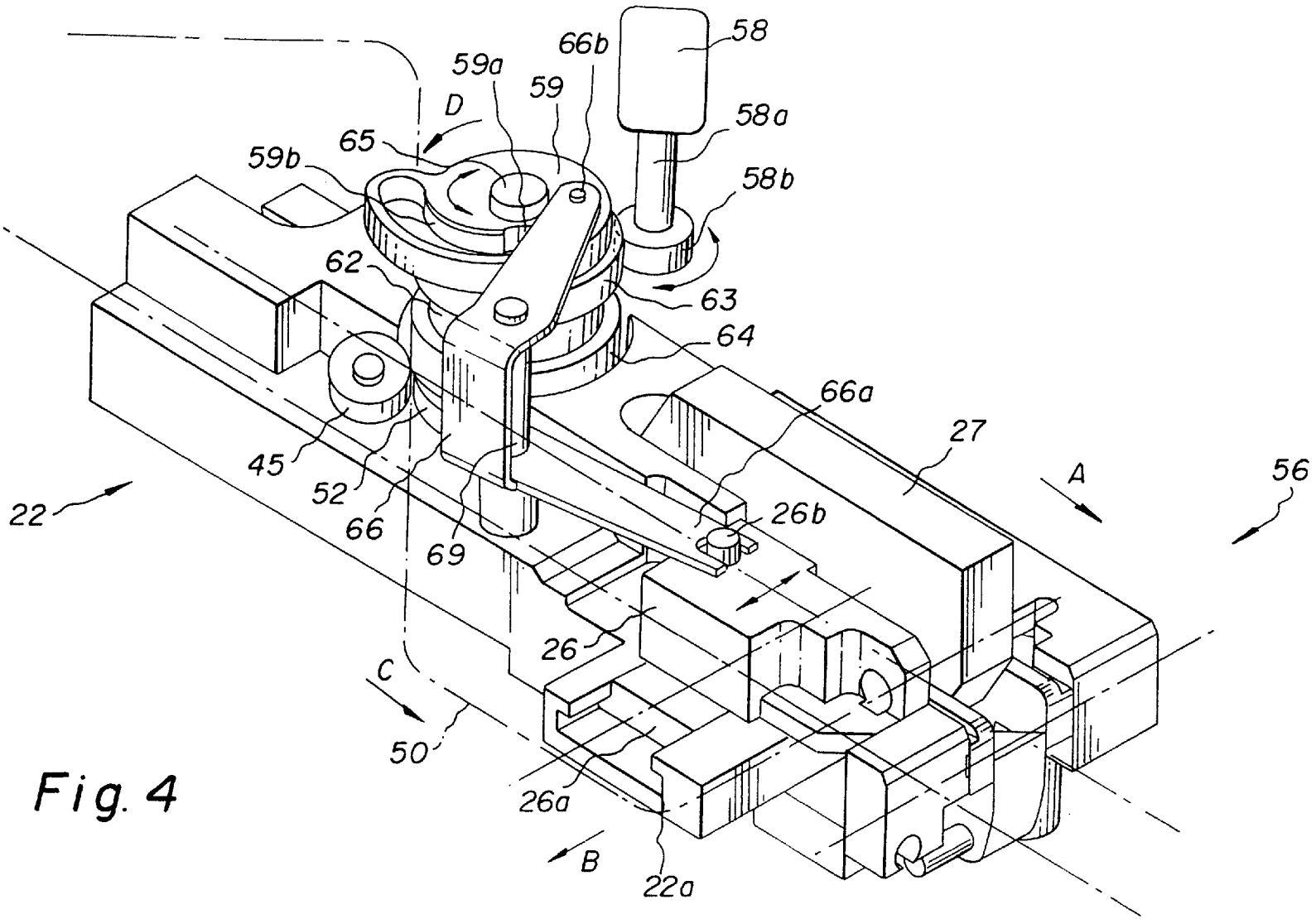
FIG. 4 is an oblique view of the stapling device of the staple wire device according to FIG. 1, without staple wire guiding means.
Figure 5:
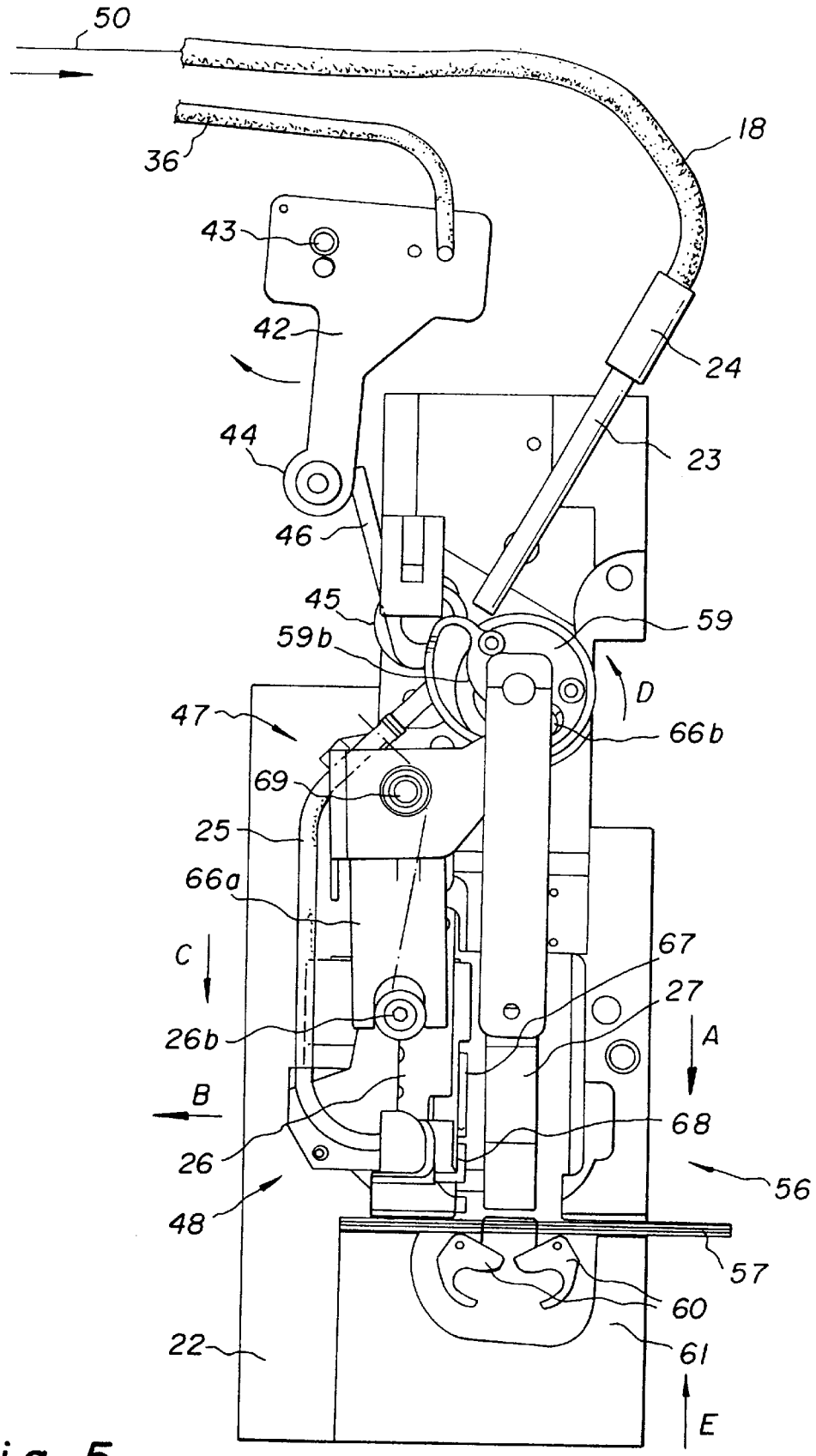
FIG. 5 is a plan view of the staple wire device according to FIG. 4, with staple wire guiding means.

Staple wire 50 (indicated with dot-dash lines in FIG. 4), which is guided from a supply roll 14 or 16 via flexible guide tube 18 to stapling device 22 or 28, passes through an inlet tube 24, depicted in FIG. 5 and attached on the stapling device, that opens into the inlet gap between transport wheel 52 and pressure roller 45. After leaving transport wheel 52 and pressure roller 45, staple wire 50 is guided through a feed-in tube 25 to cutting device 26.

The device for transporting and positioning a staple wire segment operates as follows:

Operation of stapling device 22 or 28, and driving of stepping motor 58, are accomplished by means of a control device (not depicted) of known type which ensures correct operation.

The stapling device is designed so that the thickness of each individual sheet stack is measured, and the suitable length of the staple wire segment for the staple is determined in accordance therewith. This feature makes it possible to staple sheet stacks of different thicknesses in immediate succession without interruption.

Before each stapling cycle, radial cam unit 59 assumes a starting position that is defined by a sensor, associated with the starting position, that can be, for example, a stationary photoelectric barrier into which a lug (not depicted), arranged on radial cam unit 59, protrudes.

As already mentioned, when radial cam unit 59 as depicted in FIGS. 4 and 5 is in the starting position, the concentric cam segment 59*a* is effective. Control lever 66, resting with the one end 66*b* against cam segment 59*a*, by means of its other end 66*a* also positions cutting device 26 in a starting position which is associated with the minimum wire segment length.

The starting position of cutting device 26 and of cutting knife 67, 68 is defined so that a wire segment to be cut off is positioned centeredly with respect to shaper and driver 27 of stapling head 56. The starting position of cutting device 26 can be adjusted by means of projection 26*b* which is configured as an eccentric (not depicted).

When stepping motor 58 is then set in motion, it rotates radial cam unit 59 in arrow direction "D", thereby also, by means of overrunning clutch 62 which acts in this rotation direction as a follower clutch, entraining transport wheel 52 in arrow direction "D".

If the leading end of the wire has not yet assumed its starting position in the cutting position, which the aforementioned control device determines by the fact that switch 48 on cutting device 26 has not yet been actuated, the staple wire transport operation necessary for that purpose is then first performed. To this end, stepping motor 58 rotates radial cam unit 59 in arrow direction "D" only as far as concentric cam segment 59*a* extends, so that although staple wire transport in arrow direction "C" takes place, cutting device 26 maintains its starting position. This staple wire transport action takes place, by means of alternating changes in the rotation direction of stepping motor 58, until the leading end of the wire actuates said switch 48.

The control circuit then triggers a defined number of switching steps of stepping motor 58, which, as already mentioned, brings the leading end of the wire into the cutting position and thus into the starting position. These latter switching steps also occur, in the manner described above, within the rotation range of radial cam unit 59 delimited by concentric cam segment 59*a*.

The normal stapling cycle can now begin, by the fact that the stepping motor is set in motion. If the stack thickness being stapled consists of only two sheets, stepping motor 58 is driven by a control device of a known type (not depicted), governed by the measurement device determining the sheet stack thickness, in such a way that it rotates radial cam unit 59 only to the end of concentric cam segment 59*a*. Control lever 66 is not moved during this movement of concentric cam segment 59*a*, so that cutting device 26 with cutting knife 67, 68 also remains in the starting position.

During the rotation of radial cam unit 59 over the length of the first concentric cam segment 59*a* in arrow direction "D", the staple wire is transported by means of transport wheel 52 over a length that is necessary to form a staple for stapling two sheets together.

Once wire transport has occurred, stepping motor 58 is halted and the wire segment is cut off. For this, movable cutting blade 67 is moved toward stationary cutting blade 68 by drive means (not depicted) of stapling device 22 or 28, the movement being controlled so that the edges do not strike one another.

The cut-off wire segment is then shaped into a staple, in a known manner (not depicted), by shaper and driver 27. Sheet stack 57 being stapled is moved in arrow direction "E" by a countermember 61 driven (in a manner not depicted) by stapling device 22 or 28, and laid against stapling head 56. The staple is then driven into sheet stack 57 in arrow direction "A". The staple ends emerging from sheet stack 57 are bent over in known fashion by a clinching device 60, arranged on countermember 61 and driven (in a manner not depicted) by stapling device 22 or 28, and laid against the reverse side of sheet stack 57.

The stapled sheet stack 57 is released for removal by opening countermember 61 opposite to arrow direction "E".

When a sheet stack consisting of more than two sheets is to be stapled, the aforesaid measurement device then determines the corresponding thickness and controls stepping motor 58, which rotates radial cam unit 59 a correspondingly greater distance in arrow direction "D", as a function of that value.

In this context, the one end 66*b* of control lever 66 slides up against rising cam segment 59*b*, causing control lever 66 to pivot clockwise. This clockwise pivoting causes a movement in arrow direction "B" of cutting device 26 and of cutting knife 67, 68 arranged thereon, specifically by an amount which equals half the increase in wire segment length as compared with the minimum wire length associated with the starting position.

As radial cam unit 59 simultaneously rotates in arrow direction "D", transport wheel 52 transports staple wire 50. The length of the transported staple wire corresponds to the minimum wire length described above, plus half the increase in wire length required by the measured sheet stack thickness.

Because cutting device 26 and cutting knife 67, 68 have been moved in arrow direction "B" by half the increase in wire segment length, and the wire has been transported in arrow direction "C" by half the increase in wire segment length, the now-longer wire segment is also positioned centeredly with respect to shaper and driver 27 of stapling head 56.

Between the stapling cycles, the device is moved back into its starting position by the fact that stepping motor 58 is driven in the opposite rotation direction and radial cam unit 59 is thereby moved back opposite to arrow direction "D" into the position depicted in FIGS. 4 and 5. During this backward movement of radial cam unit 59, overrunning clutch 62 causes transport wheel 52 not to be driven, so that the staple wire does not change its position and is thereby ready in operationally correct fashion for the next transport cycle.

All other wire segment lengths that are determined by rotation of radial cam unit within second cam segment 59*b* with the rising cam profile, as governed by the measurement device which determines the thickness of the sheet stack being stapled, are transported and positioned in the same manner as described above.

Since the staple length can be matched, in the manner described above, to the particular sheet stack thickness, clean and reliable staple joins are achieved.

In a departure from the embodiment depicted in FIGS. 1 to 3, staple wire supply rolls 14 and 16 can also be mounted in a cassette (not depicted) which can then be positioned on support 3 of threading-in device 2 in a suitable manner (not depicted). A cassette of this kind can completely or partially enclose supply rolls 14 and 16 in such a way that only the leading end of the wire is accessible for threading in.

The invention has been described in detail with particular reference to certain preferred embodiments thereof, but it will be understood that variations and modifications can be effected within the spirit and scope of the invention.

What is claimed is:

1. Method for preparing, manipulating, and processing a staple wire in an apparatus for stapling sheets, in which the staple wire is fed from a supply roll to a stapling device, a wire length dependent on the sheet stack thickness is cut off and shaped into a staple, and the staple is driven into the sheet stack, characterized by the following steps:

the staple wire supply roll (14, 16) is positioned, on a support (3) that can be moved out of the stapling apparatus (1), in the moved-out position thereof, and the leading end of the wire is delivered manually to a thread-in transport device (7) arranged on the support (3);

the leading end of the staple wire is transported by the thread-in transport device (7), through a flexible guide tube (18) joined to the stapling device (22, 28) inside the stapling apparatus (1), to a standby position, signaled by a sensor (47), at the staple wire transport device (52, 45) of the stapling device (22, 28);

the support (3) is moved into the stapling apparatus (1), thereby automatically setting in motion the staple wire transport device (52, 45), on the stapling device, which transports the leading end of the staple wire to a ready position which positions the leading end of the wire in the cutting position at the staple wire cutting device (26);

the staple wire (50) is transported a suitable length by a stepping motor (58) in accordance with the thickness, as measured by a sensor, of the particular sheet stack (57) being stapled;

as a function of the requisite length of the staple wire segment to be cut off, the staple wire cutting device (26) is automatically moved by the stepping motor (58), by means of a radial cam (59) driven by the latter, into a location on the stapling head (56) of the stapling device (22, 28) which positions the staple wire segment symmetrically with respect to a staple shaper and driver (27) on the stapling device, and the wire segment is cut off; and the wire segment is automatically shaped into a staple by the shaper and driver (27), and the completed staple is driven into the sheet stack (57) being stapled.

2. Method for preparing, manipulating and processing a staple wire, as defined in claim 1, wherein the staple ends passing through the sheet stack (57) are bent over by a clinching device (60) located opposite a stapling head (56) of the stapling device (22, 28) and are laid against the reverse side of the sheet stack (57); and the clinching device (60) is arranged on a movable countermember (61) which is coupled to the drive device of the stapling device (22, 28) and lays the sheet stack (57) against the stapling head (56).

3. Device for preparing, manipulating, and processing a staple wire in an apparatus for stapling sheets, in which the staple wire is fed from a supply roll to a stapling device, a wire length dependent on the sheet stack thickness is cut off and shaped into a staple, and the staple is driven into the sheet stack, as defined in claim 2, wherein:

the support (3) and the thread-in transport device (7) constitute a threading-in device (2) for the staple wire (50); and the transport device (7) of the threading-in device (2) is positively coupled via control means (36, 37) to a pressure roller (45) of the transport device (45, 52) of the stapling device (22, 28) such that when the threading-in device (2) is moved into the stapling apparatus (1), a pressure roller (8) of the transport device (7) of the threading-in device (2) is movable into an ineffective position and the pressure roller (45) of the transport device (45, 52) of the stapling device (22, 28) is movable into an effective position, and that when the threading-in device (2) is moved out of the stapling apparatus (1), the pressure roller (8) of the transport device (7) of the threading-in device (2) is movable into an effective position and the pressure roller (45) of the transport device (45, 52) of the stapling device (22, 28) is movable into an ineffective position.

4. Device for preparing, manupulating, and processing a staple wire as defined in claim 3, wherein the transport device (7) of the threading-in device (2) has a roller pair (8, 9) for transporting the staple wire (50), having a drivable transport roller (9) and a pivotable pressure roller (8) associated with the latter; and arranged at the inlet of the roller gap of the roller pair (8, 9) associated with the supply roll (14 or 16) is a feed-in tube (13, 13*a*), directed toward the roller gap, which is funnel-shaped at its opening (13*a*) associated with the supply roll (14 or 16).

5. Device for preparing, manupulating, and processing a staple wire as defined in claim 4, wherein a feed-in tube (19) into which one end of the flexible guide tube (18) opens is directed toward the outlet gap of the roller pair (8, 9).

6. Device for preparing, manupulating, and processing a staple wire as defined in claim 5, wherein the other end of the flexible guide tube (18) opens directly into the staple wire inlet (23) of the stapling device (22, 28).

7. Device for preparing, manupulating, and processing a staple wire as defined in claim 6, wherein the threading-in device (2) is arranged on a support (3) guided displaceably in the manner of a drawer on pull-out rails (4).

8. Device for preparing, manupulating, and processing a staple wire as defined in claim 7, wherein support (3) has a substantially vertically arranged wall (5 or 6) on which the transport device (7) associated with the adjacently mounted supply roll (14 or 16), and the feed-in tube (13 or 19), are arranged.

9. Device for preparing, manupulating, and processing a staple wire as defined in claim 7, wherein the support (3) has two walls (5 and 6) arranged substantially vertically; and the transport devices (7) and feed-in tubes (13, 19) associated with the adjacently mounted supply rolls (14 and 16) are arranged on the opposite sides of each of said walls (5 and 6).

10. Device for preparing, manupulating, and processing a staple wire as defined in claim 8, wherein the pressure roller (8) of the transport device (7) is rotatably mounted on a pivotable lever (11) that is arranged pivotably about a stationary bearing (12) on the wall (5 or 6);

a two-armed control arm (39) is mounted pivotably about the same staionary bearing (12);

the control arm (39) and the lever (11) are joined to one another at their one end by means of a pin (33); and a spring (35) laying the pressure roller (8) against the transport roller (9) engages in this region;

a wire (37) of a sheathed cable (36) is attached at the other end of the lever (11); and a slide roller (40) associated with the housing (29) of the stapling apparatus (1) is rotatably mounted at the other end of the control arm (39).

11. Device for preparing, manupulating, and processing a staple wire as defined in claim 9, wherein the pressure rollers (8) of the transport devices (7) are each rotatably mounted on a pivotable lever (11) that is arranged pivotably about a stationary bearing (12) on the walls (5 and 6);

a two-armed control arm (39) is arranged between the walls (5 and 6) and is mounted pivotably about the same bearing (12);

the control arm (39) and the levers (11) are joined to one another at their one end by means of a pin (33); and a spring (35) laying the pressure rollers (8) against the transport rollers (9) engages in this region;

a wire (37) of a sheathed cable (36) is attached at the other end of each lever (11); and a slide roller (40) associated with the housing of the stapling apparatus (1) is rotatably mounted at the other end of the control arm (39).

12. Device for preparing, manupulating, and processing a staple wire as defined in claim 11, wherein the threading-in device (2) has a guide element (17) which guides the staple wire (50) from the periphery of the supply roll (14 or 16) to the feed-in tube (13) and is arranged immovably at its one end facing the feed-in tube (13); and the guide element (17) is arranged approximately coaxially with the pivot bearing of the staple wire supply roll (14 or 16), and is configured at its other end in elastically resilient fashion.

13. Device for preparing, manupulating, and processing a staple wire as defined in claim 12, wherein a pivotably mounted arm (21) which exerts a braking force, the free end (21*a*) of which projects out beyond the diameter of the supply roll (14 or 16), rests on the coil diameter of the staple wire supply roll (14 or 16); and sensors which signal the position (21*a*, 21*b*) of the arm (21), and thus the supply of staple wire, are arranged in the movement path of said free end (21*a*).

14. Device for preparing, manupulating, and processing a staple wire as defined in claim 13, wherein a spindle (15) for mounting the staple wire supply roll (14 or 16) is arranged on the wall (5 or 6) of the support (3); the staple wire supply roll (14 or 16) can be axially immobilized by a securing lever (30) that is pivotable perpendicular to its rotation axis; and the arm (21) projects into the movement path of the securing lever (30) in such a way that when the securing lever (30) is opened, the arm (21) can be lifted away from the staple wire supply roll (14 or 16).

15. Device for preparing, manupulating, and processing a staple wire as defined in claim 14, wherein the transport rollers (8, 9) of the threading-in device (2) are equipped with mutually associated guide grooves for the staple wire (50).

16. Device for preparing, manupulating, and processing a staple wire as defined in claim 15, wherein the stationary transport roller (9) of the threading-in device (2) is joined, for manual actuation, to a handwheel (10) having a handle (10*a*).

17. Device for preparing, manupulating, and processing a staple wire as defined in claim 15, wherein the stationary transport roller (9) of the threading-in device (2) is joined to a motor drive.

18. Device for preparing, manupulating, and processing a staple wire as defined in claim 17, wherein the staple wire transport device (52, 45) of the stapling device (22, 28) can be driven by a stepping motor whose drive direction is reversible and which can be activated by a measurement device which determines the thickness of the stack being stapled;

the stepping motor (58) is coupled to the staple wire transport device (52, 45) by means of a coupling (62, 63, 64) that is effective only in the staple wire transport direction (C);

the stepping motor (58) is continuously coupled to a movable radial cam unit (59) which controls a displacement of the staple wire cutting device (26); and the radial cam unit (59) has control segments (59*a* and 59*b*) which are associated with different sheet stack thicknesses.

19. Device for preparing, manupulating, and processing a staple wire as defined in claim 18, wherein the radial cam unit (59), a transport wheel (52) of the staple wire transport device (52, 45), and the coupling (62, 63, 64) are arranged rotatably on a common shaft (7);

the radial cam unit (59) and the one end (63) of the coupling (62, 63, 64) are joined rigidly to one another;

the one end (62) of the coupling (62, 63, 64) is in engagement with the stepping motor (58); and the transport wheel (52) is joined to the other end (64) of the coupling (62, 63, 64).

20. Device for preparing, manupulating, and processing a staple wire as defined in claim 19, wherein the radial cam unit (59) has a first cam segment (59*a*) arranged concentrically with the rotation axis of the shaft (65) and associated with a minimum wire segment length, and a second cam segment (59*b*), adjacent thereto, associated with greater wire segment lengths and having a rising cam profile;

a second end (66*b*) of a pivotably mounted control lever (66) engages positively onto the cam segments (59*a* and 59*b*) of the radial cam unit (59); and a first end (66*a*) of the control lever (66) is in engagement with the staple wire cutting device (26).

21. Device for preparing, manupulating, and processing a staple wire as defined in claim 20, wherein the coupling (62, 63, 64) is configured as an overrunning clutch.

22. Device for preparing, manupulating, and processing a staple wire as defined in claim 21, wherein the second end (66*b*) of the control lever (66) has a projection engaging positively into the cam segments (59*a* and 59*b*) of the radial cam unit (59); and the first end (66*a*) of the control lever (66) engages positively against a projection (26*b*) of the staple wire cutting device (26).

23. Device for preparing, manupulating, and processing a staple wire as defined in claim 22, wherein the projection (26*b*) is configured as an adjustable eccentric.

24. Device for preparing, manupulating, and processing a staple wire as defined in claim 23, wherein the cutting device (26) has cutting blades (67, 68) having opposing edges of wedge-shaped configuration.

25. Device for preparing, manupulating, and processing a staple wire as defined in claim 24, wherein the one end (63) of the coupling (62, 63, 64) is configured as a gear into whose teeth a gear (58*b*) of the stepping motor (58) engages.

26. Device for preparing, manupulating, and processing a staple wire as defined in claim 25, wherein the staple wire cutting device (26) is guided on a V-guide (22*a*, 26*a*) in positive and displaceable fashion perpendicular to the stapling direction (A).

* * * * *

UNITED STATES PATENT AND TRADEMARK OFFICE

CERTIFICATE OF CORRECTION

PATENT NO. : 5,938,388
DATED : August 17, 1999
INVENTOR(S) : Helmut Bloser et al.

It is certified that error appears in the above-identified patent and that said Letters Patent is hereby corrected as shown below:

Column 11,
Line 63, “manupulating” should read -- manipulating --

Column 12,
Lines 6, 10, 14, 18, 24, 31, and 49, “manupulating” should read -- manipulating --
Line 38, “staionary” should read -- stationary --.

Column 13,
Lines 1, 10, 19, 29, 33, 38 and 42, “manupulating” should read -- manipulating --

Column 14,
Lines 4, 16, 28, 32, 38, 41, 45 and 49, “manupulating” should read -- manipulating --

Signed and Sealed this

Eleventh Day of March, 2003

JAMES E. ROGAN
*Director of the United States Patent and Trademark Office*